US009180677B2

(12) United States Patent
Leoni et al.

(10) Patent No.: US 9,180,677 B2
(45) Date of Patent: Nov. 10, 2015

(54) HARD IMAGING DEVICES AND HARD IMAGING DEVICE OPERATIONAL METHODS

(75) Inventors: Napoleon J. Leoni, San Jose, CA (US); Omer Gila, Cupertino, CA (US); Michael H. Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 43 days.

(21) Appl. No.: 13/384,887

(22) PCT Filed: Jan. 25, 2010

(86) PCT No.: PCT/US2010/022005

§ 371 (c)(1),
(2), (4) Date: Jan. 19, 2012

(87) PCT Pub. No.: WO2011/090487

PCT Pub. Date: Jul. 28, 2011

(65) Prior Publication Data

US 2012/0281041 A1 Nov. 8, 2012

(51) Int. Cl.

| | |
|---|---|
| ***B41J 2/165*** | (2006.01) |
| ***B41J 2/185*** | (2006.01) |
| ***B41J 2/17*** | (2006.01) |
| ***B41J 2/175*** | (2006.01) |

(52) U.S. Cl.
CPC *B41J 2/185* (2013.01); *B41J 2/175* (2013.01); *B41J 2/1714* (2013.01)

(58) Field of Classification Search
None
See application file for complete search history.

(56) References Cited

U.S. PATENT DOCUMENTS

| | | | | |
|---|---|---|---|---|
| 4,851,863 | A | 7/1989 | Yamamori et al. | |
| 6,719,398 | B1 * | 4/2004 | McElfresh et al. | 347/21 |
| 7,604,332 | B2 * | 10/2009 | Nagashima | 347/84 |
| 2003/0124820 | A1 * | 7/2003 | Johnsgard et al. | 438/482 |
| 2005/0253912 | A1 * | 11/2005 | Smith et al. | 347/102 |
| 2007/0109348 | A1 * | 5/2007 | Izawa et al. | 347/34 |
| 2007/0229611 | A1 | 10/2007 | Nagashima | |
| 2011/0181658 | A1 * | 7/2011 | Izawa et al. | 347/34 |

FOREIGN PATENT DOCUMENTS

| | | |
|---|---|---|
| CN | 102196918 | 9/2011 |
| JP | 56130362 | 10/1981 |
| JP | 60-184851 | 9/1985 |
| JP | 62090252 | 4/1987 |
| JP | 03-234539 | 10/1991 |
| JP | 2005-271314 | 10/2005 |
| JP | 2009-056666 | 3/2009 |
| WO | WO-0043209 | 7/2000 |
| WO | WO-2010114534 | 10/2010 |

* cited by examiner

*Primary Examiner* — Alejandro Valencia
(74) *Attorney, Agent, or Firm* — Wells St. John Roberts Gregory & Matkin PS

(57) ABSTRACT

Hard imaging devices and hard imaging device operational methods are described. According to one arrangement, a hard imaging device includes a pen adjacent to a first location of a media path and configured to eject a plurality of droplets of a liquid marking agent in a direction towards the media moving along the media path to form hard images using the media, the ejection of the droplets of the liquid marking agent from the pen creating aerosol droplets of the liquid marking agent, and a gas injection system adjacent to a second location of the media path which is downstream from the first location with respect to a direction of movement of the media along the media path, and wherein the gas injection system is configured to inject a gas towards the media.

5 Claims, 4 Drawing Sheets

HARD IMAGING DEVICES AND HARD IMAGING DEVICE OPERATIONAL METHODS

FIELD OF THE DISCLOSURE

Aspects of the disclosure relate to hard imaging devices and hard imaging device operational methods.

BACKGROUND

Imaging devices capable of printing images upon paper and other media are ubiquitous and used in many applications including monochrome and color applications. The use and popularity of these devices continues to increase as consumers at the office and home have increased their reliance upon electronic and digital devices, such as computers, digital cameras, telecommunications equipment, etc.

A variety of methods of forming hard images upon media exist and are used in various applications and environments, such as home, the workplace and commercial printing establishments. Some examples of devices capable of providing different types of printing include laser printers, impact printers, inkjet printers, commercial digital presses, etc.

Some configurations of printers which use liquid marking agents may be subjected to contamination by satellites formed during printing operations. For example, in some inkjet configurations, the jetting of drops of a liquid marking agent may also result in the formation of satellites of the liquid marking agent which may contaminate media being imaged upon, nozzles, or other equipment of the printer. Imaging operations may be suspended to implement cleaning operations to remove the contamination which results in reduced productivity of the printer or press.

At least some aspects of the disclosure are directed towards improved imaging methods and apparatus.

DETAILED DESCRIPTION

Hard imaging devices, such as printers, may be subjected to contamination during imaging operations. For example, some inkjet printer configurations eject droplets of a liquid marking agent (e.g., ink) to form hard images upon media. The ejection of the droplets may result in the creation of satellites of the liquid marking agent which may contaminate media being imaged upon or imaging components of the hard imaging devices. The satellites have a size distribution yielding larger satellites with sufficient mass and momentum to land on the media and smaller satellites which are entrained in the air flow resulting from the media motion. This latter population of smaller satellites is commonly referred to as aerosol or mist (i.e., aerosol droplets) which remains entrained in the air flow and causes contamination of surfaces of components downstream of the printing zone. This contamination may degrade the print quality of the hard imaging device and/or result in cleaning operations which may negatively affect productivity of the hard imaging device. At least some aspects of the disclosure are directed towards methods and apparatus configured to reduce contamination caused by the generated aerosol droplets of the liquid marking agent.

Figure 1:
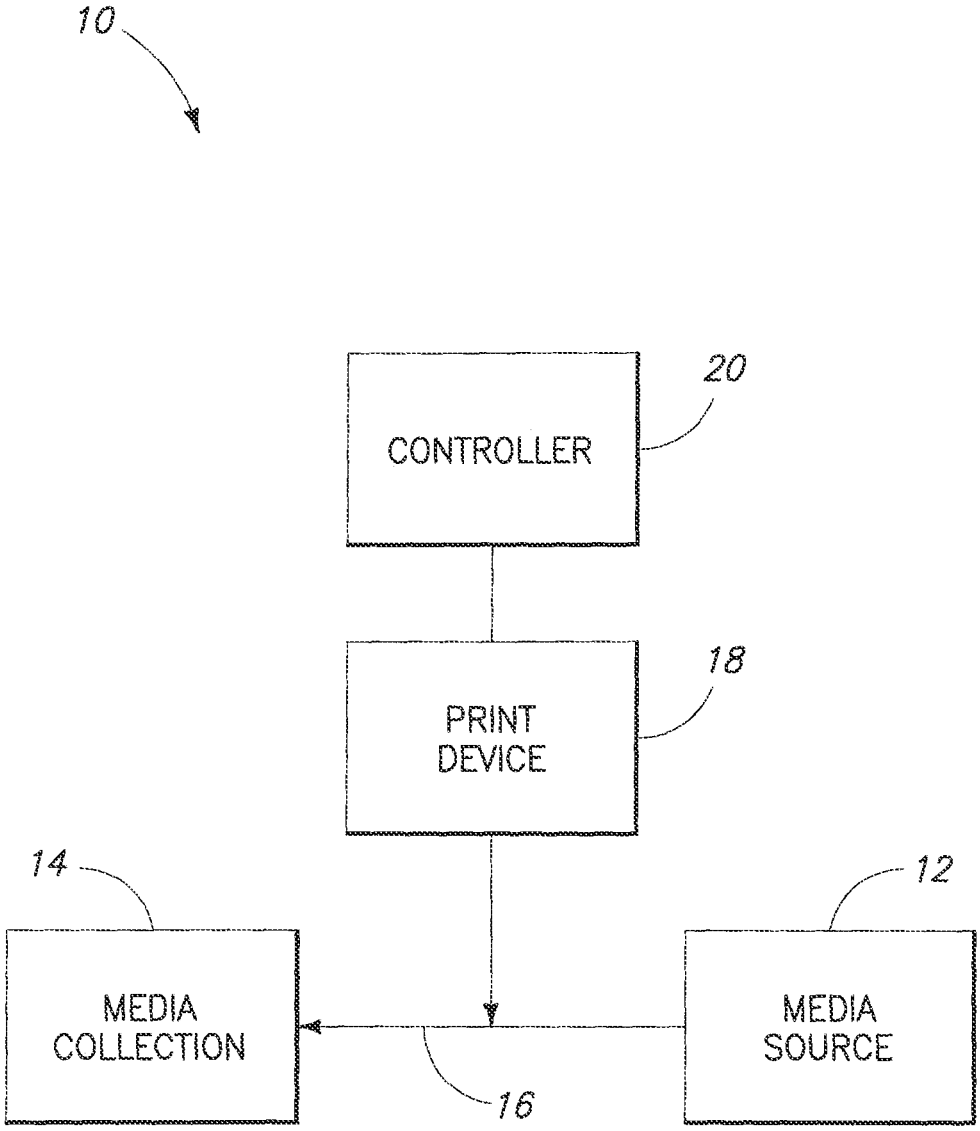
FIG. 1 is a functional block diagram of a hard imaging device according to one embodiment.

Referring to FIG. 1, an example of a hard imaging device 10 arranged according to one embodiment of the disclosure is shown. Hard imaging device 10 is configured to form hard images upon media. Example embodiments of the hard imaging device 10 include printers or digital presses although other hard imaging device configurations are possible including copiers, multiple-function devices, or other arrangements configured to form hard images upon media.

The depicted embodiment of hard imaging device 10 includes a media source 12, a media collection 14, a media path 16, a print device 18 and a controller 20. Other embodiments of hard imaging device 10 are possible and include more, less or additional components.

In one embodiment, media source 12 comprises a supply of media to be used to form hard images. For example, media source 12 may be configured as a roll of web media or a tray of sheet media, such as paper. Other media or configurations of media source 12 may be used in other embodiments.

Media travels in a process direction along the media path 16 from media source 12 to media collection 14 in example embodiments. Hard images are formed upon media travelling along the media path 16 intermediate the media source 12 and media collection 14 by print device 18 in example configurations which are described in further detail below.

Media collection 14 is configured to receive the media having hard images formed thereon following printing. Media collection 14 may be configured as a take-up reel to receive web media or a tray to receive sheet media in example embodiments.

Media source 12 and media collection 14 may form a media transport system in one embodiment of hard imaging device 10 (e.g., comprising supply and take-up reels for web media) configured to move the media along the media path 16. In another embodiment of hard imaging device 10 (e.g., sheet media), the media transport system may comprise a plurality of rollers (not shown) to move media from media source 12 to media collection 14. Any suitable arrangement to implement printing upon media by print device 18 may be used.

Print device 18 is configured to provide one or more liquid marking agents to media travelling along media path 16 to form the hard images in one embodiment. In one embodiment, the liquid marking agents may include one or more colors of inks. Different types of inks, such as aqueous, solvent or oil based, may be used depending upon the configuration of the hard imaging device 10. Furthermore, the liquid marking agents may include a fixer or binder, such as a polymer, to assist with binding inks to the media and reducing penetration of the inks into the media.

In one embodiment, print device 18 comprises an inkjet print head (e.g., piezo, thermal, etc.) configured to eject a plurality of droplets of the liquid marking agent corresponding to an image to be formed. Hard imaging device 10 may be configured to generate color hard images in one embodiment, and print device 18 may include a plurality of pens (not shown in FIG. 1) configured to provide droplets of the liquid marking agent having different colors (e.g., different colored inks) and fixers or binders (if utilized). Other arrangements of print device 18 are possible.

In one embodiment, controller 20 is arranged to process data (e.g., access and process digital image data corresponding to a color image to be hard imaged upon media), control data access and storage, issue commands to print device 18, monitor imaging operations and control imaging operations of hard imaging device 10. In one embodiment, controller 20 is arranged to control operations described herein with respect to removal of aerosol droplets of the marking agent generated during imaging operations. In one arrangement, the controller 20 comprises circuitry configured to implement desired programming provided by appropriate media in at least one embodiment. For example, controller 20 may be implemented as one or more of a processor and/or other structure configured to execute executable instructions including, for example, software and/or firmware instructions, and/or hardware circuitry. Example embodiments of controller 20 include hardware logic, PGA, FPGA, ASIC, state machines, and/or other structures alone or in combination with a processor. These examples of controller 20 are for illustration and other configurations are possible.

Figure 2:
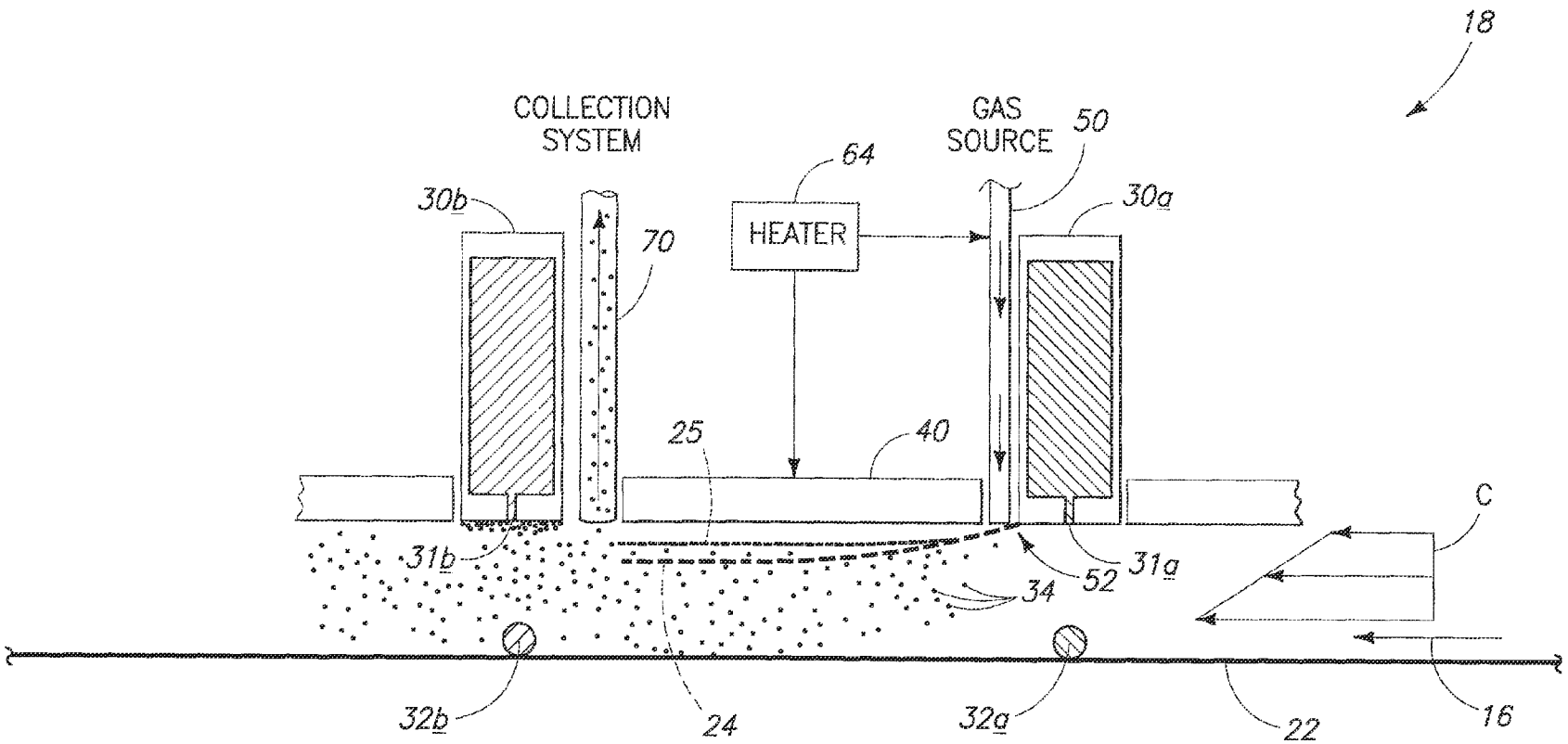
FIG. 2 is an illustrative representation of a print device according to one embodiment.

Referring to FIG. 2, one embodiment of print device 18 configured as an inkjet printhead configured to form color hard images is shown. The print device 18 is configured to form hard images upon media 22 travelling along media path 16 as shown. The movement of media 22 travelling along media path 16 generates an air boundary layer 24 generally corresponding to a boundary where air below the boundary layer 24 moves with the media 22 in the direction of travel of the media 22 along the media path 16 while air above the boundary layer 24 is not significantly affected by the travelling media 22.

Print device 18 includes a plurality of pens 30*a*, 30*b* in the depicted arrangement configured to form hard color images. Other arrangements of print device 18 include a single pen 30 configured to eject a marking agent having a single color for monochrome applications. Pens 30*a*, 30*b* include respective nozzles 31*a*, 31*b* which are configured to eject droplets 32*a*, 32*b* of the liquid marking agent toward media 22 moving along media path 16. In the described embodiment, pens 30*a*, 30*b* are configured to eject the droplets 32*a*, 32*b* comprising different colors of ink (e.g., cyan, magenta, yellow, or black). Print device 18 may include additional pens to eject droplets of marking agent of additional colors and/or fixers or binders in some embodiments.

In the depicted embodiment, the pens 30*a*, 30*b* are arranged in series one after another along the media path 16 and are configured to eject the droplets 32*a*, 32*b* upon media 22 moving along paper path 16 to form color images in a single pass of the media 22 adjacent to print device 18. In other embodiments, the different colors may be deposited upon media 22 in a plurality of passes of the media 22 adjacent to the print device 18. In yet an additional embodiment, print device 18 only includes a single pen to form black and white images as mentioned above. In one embodiment, nozzles 31*a*, 31*b* are spaced a desired distance (e.g., 0.5 mm-1.0 mm) from media 22.

FIG. 2 shows droplets 32*a*, 32*b* of liquid marking agent upon media 22. The ejection of droplets 32*a*, 32*b* by pens 30*a*, 30*b* to form hard images upon media 22 generates plural aerosol droplets 34 of the respective different colors of the liquid marking agent. In particular, droplets 32*a*, 32*b* may individually have an elongated shape as they are ejected from nozzles 31*a*, 31*b* due to adhesion forces between the ejected liquid marking agent and the nozzles 31*a*, 31*b*. The heads of the droplets 32*a*, 32*b* may move at faster rates away from pens 30*a*, 30*b* compared with the tail portions of the droplets 32*a*, 32*b* which may lose their initial speed breaking away from the droplets 32*a*, 32*b* and creating the aerosol droplets 34.

The aerosol droplets 34 are relatively small and light droplets (e.g., sub-pL) compared with the ejected droplets 32*a*, 32*b* and may remain suspended in a region of air adjacent to media 22 and downstream of the pens 30*a*, 30*b* while droplets 32*a*, 32*b* continue to move downward to the media 22. In one embodiment, the droplets 32*a*, 32*b* individually have a diameter of approximately 12-40 microns and a volume between 1 to 40 pL while the aerosol droplets individually have a diameter of approximately 1-10 microns and a volume of approximately 0.01 to 0.3 pL. These aerosol droplets 34 may land upon various components of the hard imaging device 10 (e.g., pens 30*a*, 30*b*) and/or media 22. Aerosol droplets 34 may additionally land upon and contaminate other components, such as a component 40 in the form of a pen support structure 40 in the illustrated embodiment and which is positioned adjacent to and over the media path 16. The aerosol droplets 34 may contaminate other components of hard imaging device 10 in other embodiments. Aerosol droplets 34 landing upon the pens 30*a*, 30*b*, media 22 or other components 40 may degrade the print quality of hard images being formed upon media 22.

More specifically, FIG. 2 illustrates an example component 40 which is downstream of pen 30*a*. The component 40 may be a support structure for pen 30*a* and/or pen 30*b* in one example. Aerosol droplets 34 created by the ejection of droplets 32*a* from pen 30*a* may be drawn downstream by the movement of the media 22 and adhere to the lower surface of component 40 thereby contaminating component 40. The adhered aerosol droplets 34 may accumulate into a puddle of the liquid marking agent which may drip upon the media 22 resulting in degraded print quality in one example. Furthermore, as mentioned above, a fixer or binder may also be ejected by one of the pens 30 which may also contaminate and adversely affect printing operations.

As shown in FIG. 2, the movement of media 22 may create a couette flow C between the pens 30*a*, 30*b* and media 22 resulting a shear stress which may drag liquid marking agent which may have accumulated on the lower surfaces of pens 30*a*, 30*b* and aerosol droplets 34 in a downstream direction with respect to the direction of movement of the media 22 and the couette flow C.

In one embodiment, a gas injection system 50 is utilized to direct gas towards media 22 travelling along the media path 16. Air speed is null adjacent to the surface of pen 30*a* which results in the creation of first and second boundary layers 24, 25 from the injected gas. In the illustrated embodiment, layers 24, 25 are created between the media path 16 and component 40 and boundary layer 24 is closer to media path 16 and boundary layer 25 is closer to component 40. Although only one gas injection system 50 is shown in FIG. 2 (i.e., downstream of pen 30*a*), another gas injection system 50 may be provided downstream of pen 30*b*.

The first boundary layer 24 may be referred to as a momentum boundary layer and second boundary layer 25 may be referred to as a diffusion boundary layer. First boundary layer 24 impedes movement of aerosol droplets 34 upward, however, some aerosol droplets 34 cross the boundary layer 24 into a transition region intermediate layers 24, 25. More specifically, some aerosol droplets 34 migrate upwardly through boundary layer 24 into the transition region due to diffusion. The second boundary layer 25 also impedes further upwardly movement of aerosol droplets 34 within the transition region which reduces contamination of the lower surface of component 40 due to the aerosol droplets 34 compared within an arrangement which does not utilize gas injection system 50 or such system 50 is not operating. In one embodiment using gas injection system 50, the concentration of droplets 34 in the transition region is reduced from a region immediately above the first boundary layer 24 to substantially null above boundary layer 25.

In the depicted example, gas injection system 50 includes a supply system configured to inject a stream of gas from an appropriate source. In the depicted embodiment, gas injection system 50 is configured to inject the gas into a region adjacent to and above the media path 16 and in a direction towards the media 22. In the depicted embodiment, the gas injection system 50 is configured to inject the gas at a location which is downstream from the location of the pen 30*a* with respect to the process direction corresponding to the direction of movement of the media 22 along the media path 16. In one embodiment, the pen 30*a* and gas injection system 50 are positioned adjacent to a common side of the media path 16 and immediately adjacent to one another.

In one embodiment, the gas injection system 50 ejects the gas via a nozzle or port 52 which may be in the form of a slit which extends in a direction across substantially an entirety of the width of pen 30*a* in a direction which is substantially perpendicular to the process direction in one embodiment. Appropriate sources of gas may be a pressurized gas source (e.g., air), a fan configured to provide a flow of gas to toward the media path 16, for example, via a manifold, or any other suitable arrangement. The gas injection speed is typically of the same order of magnitude as the media speed with a gas flow which is a fraction (e.g., 10-50%) of the air flow rate generated between the media 22 and pen 30*a* due to movement of media 22.

In one embodiment, it is desired to avoid significant recirculations or vortices from occurring from the injection of gas by system 50 to provide the reduced contamination. Furthermore, it is desired to also provide controlled growth of the boundary layers 24, 25 in one embodiment to assist with the reduction of contamination. The boundary layers 24, 25 grow in opposite directions as the injected gas and air within the imaging region (e.g., the region below pen 30*a* and component 40) move leftward away from nozzle 52. First boundary layer 24 grows in a downward direction and second boundary layer 25 grows in an upward direction.

In one embodiment, it is desired for reduced contamination of surface 40 that second boundary layer 25 does not grow sufficiently upward to reach surface 40 whereupon the boundary effects of layer 25 would be reduced. In one embodiment, the Schmidt Number (Sc), which is a non-dimensional number, is used to compare the first and second boundary layers 24, 25. The Schmidt Number is a comparison or ratio of momentum diffusivity and particle diffusivity which may be calculated according to Equation 1 in one embodiment:

$$Sc = \frac{v}{D} = \frac{6\pi \cdot v^2 \cdot r}{k \cdot T} \qquad \text{Eqn. 1}$$

Where v is kinematic viscosity of air at atmospheric conditions; D is the diffusion constant for spherical ink aerosol droplets in air; r is the radius of the aerosol droplets; T is the temperature of the medium (i.e., air) adjacent to the media path 16; and k is the Boltzmann constant.

The diffusivity of ink droplets in air (D) is computed assuming Stokes' drag on the droplets in one embodiment. If the Schmidt Number is greater than unity, the first boundary layer grows 24 at a faster rate away from the lower surface of component 40 than the second boundary layer 25 as their ratio is approximately the square root of the Schmidt Number.

Figure 3:
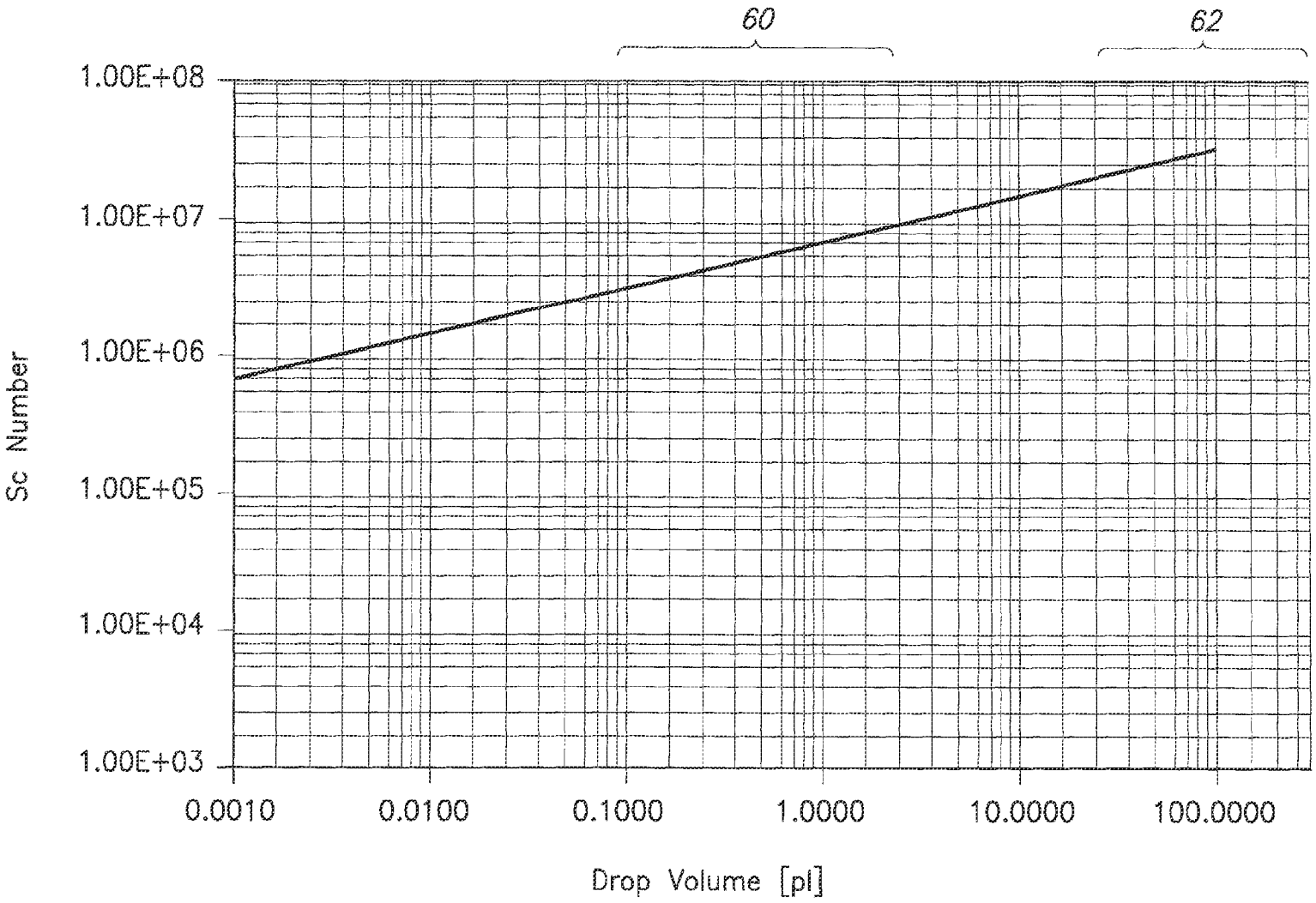
FIG. 3 is a graphical illustration of different values of the Schmidt number versus droplet volumes.

FIG. 3 shows a plot of the Schmidt Number as a function of aerosol drop volume in picoliters (pL). FIG. 3 illustrates a first range 60 corresponding to typical volumes of aerosol droplets 34 of the liquid marking agent and a second range 62 corresponding to typical ranges of droplets of the liquid marking agent. As illustrated in FIG. 3, the Schmidt Number is larger than 1 for the volume range of interest 60 corresponding to the aerosol droplets. Accordingly, it is believed that the above-described example apparatus and methods should reduce contamination upon surfaces of components of the hard imaging device with a sufficient margin of safety.

Some of the aerosol droplets 34 may be converted to water vapor. It is desired to avoid condensation of water vapor upon components of the hard imaging device 10, such as the lower surface of component 40, which may also adversely impact print quality. For example, condensed water vapor droplets upon the lower surface of component 40 may drip upon media 22 being imaged upon.

The Schmidt Number may be calculated for water vapor. The vapor diffusivity in air at standard atmospheric conditions is $2.11\times10^{-5}$ which provides a Schmidt Number of 0.711 using Eqn. 1. This value is less than 1 indicating that the gas injection described above is less robust with respect to preventing water vapor from contacting component 40 compared with preventing the aerosol droplets 34 from contacting component 40.

Accordingly, in one embodiment, a heater 64 is configured to preheat the gas which is to be injected via gas injection system 50 and/or to heat components adjacent to the media path 16, such as component 40. Heating of the injected gas and/or the components assists with reduction of condensation of the water vapor upon component 40 compared with arrangements which do not use the described heating.

According to some embodiments described herein, hard imaging device 10 includes an aerosol droplet removal system 70 which is configured to remove at least some of the aerosol droplets 34 from regions of air adjacent to the media path 16. In the illustrated example, aerosol droplet removal system 70 is positioned at a location downstream from pen 30*a* and upstream from pen 30*b*. The depicted aerosol droplet removal system 70 includes a suction device configured to introduce a suction to remove the aerosol droplets 34 from regions adjacent to the media path 16 and to collection the aerosol droplets in a collection system. Other configurations of aerosol droplet removal system 70 are possible. For example, aerosol droplet removal system 70 may be arranged as described in a co-pending PCT application, entitled "Hard Imaging Devices and Hard Imaging Methods," having application serial no. PCT/US2009/039150, filed Apr. 1, 2009, listing Omer Gila, Napoleon J. Leoni, and Michael H. Lee as inventors, and assigned to the assignee hereof.

Figure 4:
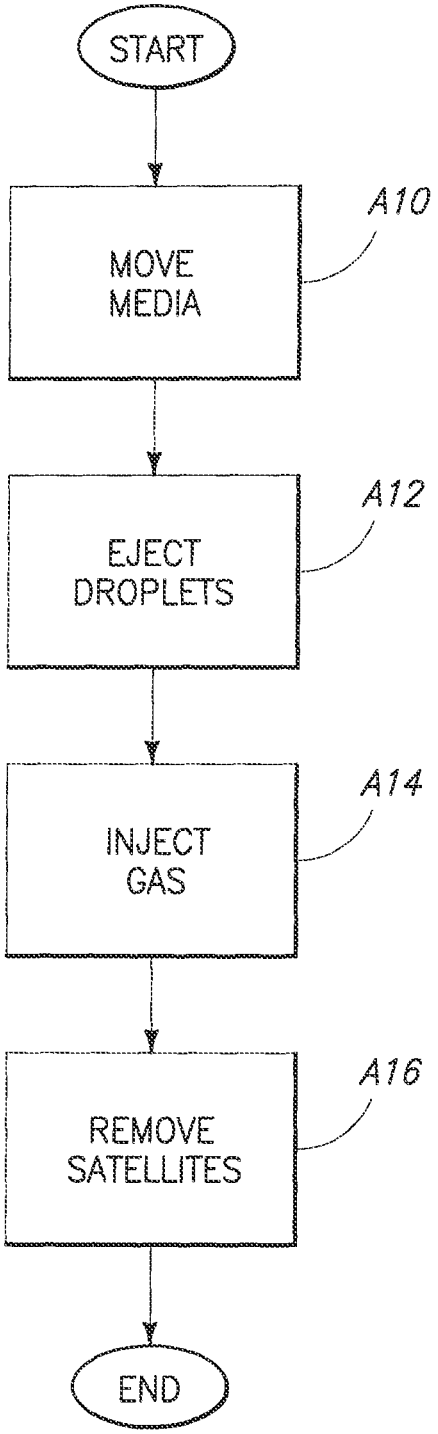
FIG. 4 is a flow chart of a method of removing aerosol droplets according to one embodiment.

Referring to FIG. 4, one example hard imaging method is shown according to one embodiment. Other methods are possible including more, less and/or alternative acts in other embodiments.

At an act A10, media to be imaged upon may be moved along the media path from the media source.

At an act A12, one or more pens may eject a plurality of droplets of liquid marking agent to form hard images. The ejection of the droplets may result in the formation of a plurality of aerosol droplets of the liquid marking agent in the region of air adjacent to the media path.

At an act A14, the gas injection system injects one or more streams of gas downstream from one or more pens in a direction towards the media path to create one or more respective boundary layers. The boundary layers reduce contamination upon components of the hard imaging device resulting from the aerosol droplets.

At an act A16, at least some of the aerosol droplets are removed from regions of air adjacent to the media path, for example using an aerosol droplet removal system in one embodiment.

In one experimental application of the gas injection system described herein, contamination resulting from aerosol droplets upon support structures was greatly reduced by the use of the gas injection system. In this specific example, approximately 5,400 pages were imaged at 43% coverage and a process velocity of 1 m/s using a single color of a liquid marking agent. No cleaning of components was needed with the presence of injected gas by the gas injection system while noticeable contamination of components downstream of the nozzle was noticed in the absence of injected gas by the gas injection system.

As described above, apparatus and methods are disclosed according to some embodiments which provide reduced contamination of components of the hard imaging device which may result from the presence of aerosol droplets of liquid marking agent generated by printing upon media. At least some aspects reduce accumulation of the liquid marking agent aerosol droplets upon components of the hard imaging device which may adversely affect print quality of printed output (e.g., reduce accumulation of liquid marking agent aerosol droplets over the paper path which may drip upon media in one illustrative example). Some of the described embodiments reduce or eliminate the contamination, and accordingly reduce the frequency of or eliminate cleaning cycles which remove the contamination from the components.

In addition, at least some aspects of the disclosure may be implemented to reduce contamination caused by aerosol droplets which may be trapped within the boundary layer and not removed by some suction or other techniques. Additionally, at least some aspects of the disclosure remove aerosol droplets without use of high air flow devices which may negatively impact print quality (e.g., super air knives emitting air at dozens of meters per second which may smear dots and/or alter trajectories of emitted dots in flight). Additionally, regions between the air flow devices (e.g., suction devices) or other aerosol droplet removal systems and the nozzles of these other arrangements may still be contaminated by the aerosol droplets of liquid marking agents in the absence of gas injection systems described herein.

Aspects of the present disclosure may be implemented without compromising print quality as the injected gas may be optimized to not adversely affect air flow conditions in the vicinity of the pens. Additionally, the disclosed structure and methods may be implemented in conjunction with other aerosol droplet removal systems.

The protection sought is not to be limited to the disclosed embodiments, which are given by way of example only, but instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

The invention claimed is:

1. A method comprising:

moving media along a media path in a hard imaging device;

at a first location along the media path, ejecting a plurality of droplets of a liquid marking agent in a direction towards the media to form a hard image using the media, the ejecting creating a plurality of aerosol droplets of the liquid marking agent; and at a second location along the media path downstream from the first location with respect to a direction of movement of the media along the media path, injecting a gas towards the media path to create a first boundary layer to impede movement of the aerosol droplets in a direction away from the media and to reduce an air speed at the first location to substantially null, the first boundary layer to reduce contamination of a component of the hard imaging device by the aerosol droplets compared with an absence of the injecting of the gas.

2. The method of claim 1 further comprising, at another location which is downstream from the first location, removing at least some of the aerosol droplets from a region adjacent to the media path.

3. The method of claim 1 wherein the injecting of the gas creates a second boundary layer to further impede the movement in an upward direction of the aerosol droplets.

4. The method of claim 3, wherein the upward direction comprises a direction away from the media.

5. The method of claim 1, wherein the component of the hard imaging device is downstream from the second location with respect to the direction of movement of the media along the media path.

* * * * *